United States Patent [19]

Jahns et al.

[11] 4,358,223

[45] Nov. 9, 1982

[54] METHOD AND APPARATUS FOR CONSTRUCTING BURIED PIPELINE SYSTEMS

[75] Inventors: Hans O. Jahns; Christopher E. Heuer; Hsiu-Hsyong Hsu, all of Houston, Tex.

[73] Assignee: Exxon Production Research Co., Houston, Tex.

[21] Appl. No.: 173,301

[22] Filed: Jul. 29, 1980

[51] Int. Cl.[3] ..... E02D 19/14

[52] U.S. Cl. ..... 405/157; 405/154

[58] Field of Search ..... 405/154, 157, 130; 264/31-35; 404/27, 28, 31

[56] References Cited

U.S. PATENT DOCUMENTS

| | | | |
|---|---|---|---|
| 2,737,092 | 3/1956 | Gramelspacher | 404/28 |
| 3,135,097 | 6/1964 | Scheinberg | 405/130 X |
| 3,250,188 | 10/1966 | Leonards | 404/31 |
| 3,602,263 | 8/1971 | Bremner | 405/154 X |
| 3,650,119 | 3/1972 | Sparling | 405/157 X |
| 3,655,564 | 4/1972 | Barrington | 405/157 X |
| 3,675,432 | 7/1972 | Keene . | |
| 3,747,355 | 7/1973 | Howard | 405/157 |
| 3,880,538 | 4/1975 | Burt et al. | 404/28 |
| 3,910,710 | 10/1975 | Gagle et al. | 404/31 X |
| 3,952,529 | 4/1976 | Lefever | 405/154 |
| 4,036,285 | 7/1977 | Best . | |
| 4,068,488 | 1/1978 | Ball | 405/157 |
| 4,090,686 | 5/1978 | Yarbrough | 405/154 |
| 4,194,856 | 3/1980 | Jahns . | |
| 4,269,539 | 5/1981 | Hopke | 405/157 X |

OTHER PUBLICATIONS

Mirosh, E. A., "Permafrost Protection", presented at the 6th International Pipeline Technology Conference, Houston, Texas, Mar. 21-23, 1978, pp. 247-253.

K. A. Linell, "Long-Term Effects of Vegetative Cover on Permafrost Stability in an Area of Dicontinuous Permafrost", Permafrost, Second International Conference, Proceedings, pp. 688-693, National Academy of Sciences, Washington, D.C., 1973.

C. T. Hwang and F. C. Yip, "Advances in Frost Heavy Prediction and Mitigation Methods for Pipeline Application", ASME Paper No. 77-WA/HT-19, presented at Winter Annual Meeting of ASME, Atlanta, Georgia, Nov. 27-Dec. 2, 1977.

D. M. Coulter, C. T. Hwang and F. C. Yip, "Prediction of Frost Formation Around a Chilled Natural Gas Pipeline", ASME Paper No. 75-WA/HT-88, presented at Winter Annual Meeting of ASME, Houston, Texas, Nov. 30-Dec. 4, 1975.

B. E. Davison, D. Nottingham, J. W. Rooney and C. L. Vita, "Chilled Pipeline Frost Heave Mitigation Concepts", Proceedings of ASCE Conference on Pipelines in Adverse Environments, vol. 1, pp. 294-306, New Orleans, Louisiana, Jan. 15-17, 1979.

E. W. Browning, "Pipe Stress Due to Frost Heave", Gas, Aug. 1970, pp. 74-77.

G. G. King, "Cooling Arctic Gas Pipelines Can Increase Flow, Avoid Thaw", *The Oil and Gas Journal,* Aug. 15, 1977, pp. 58-66.

G. King, "The How and Why of Cooling Arctic Gas Pipelines", Parts I and II, *Pipeline and Gas Journal,* Sep. and Oct., 1977.

A. C. Mathews, "Natural Gas Pipeline Design and Construction in Permafrost and Discontinuous Permafrost", SPE 6873 (1977).

J. A. Wheeler, "Simulation of Heat Transfer from a Warm Pipeline Buried in Permafrost", presented at the Seventy-Fourth National Meeting of AIChE, New Orleans, Louisiana, Mar. 11-15, 1973.

T. W. Miller, "The Surface Heat Balance in Simulations of Permafrost Behavior", presented at the Winter Annual Meeting of ASME, Houston, Texas, Nov. 30-Dec. 4, 1975.

W. A. Stusarchuk, et al., "Field Test Results of a Chilled Pipeline Buried in Unfrozen Ground", Proceedings of the Third International Conference on Permafrost, sponsored by the National Research Council of Canada, vol. 1, pp. 877-883, Jul. 10-12, 1978.

*Primary Examiner*—Dennis L. Taylor

*Attorney, Agent, or Firm*—Keith A. Bell

[57] ABSTRACT

A method and apparatus for mitigating or eliminating the frost heave of refrigerated pipelines buried in frost-susceptible soil are provided. A blanket of heat absorbent material is placed over the pipeline on the surface of the soil to increase the flow of heat into the region surrounding the pipeline. This technique may be used in combination with other frost heave mitigation techniques, such as insulating the pipeline and supporting the pipeline with a heave resistant bedding material.

38 Claims, 8 Drawing Figures

METHOD AND APPARATUS FOR CONSTRUCTING BURIED PIPELINE SYSTEMS

BACKGROUND OF THE INVENTION

1. Field of the Invention

This invention relates to a buried pipeline system for transporting cold product such as refrigerated natural gas through frost-susceptible ground or soil. In particular, the invention pertains to a pipeline system for reducing or eliminating frost heaving of the pipeline due primarily to long-term formation of freeze bulbs around the pipeline.

2. Description of the Prior Art

Recent discoveries of vast quantities of natural gas in the Arctic have created a need for very high flow capacity pipeline systems to transport the natural gas from the Arctic to gas consumers located in more temperate regions of the world. It is now generally accepted that one mode of accomplishing this transportation is by the use of buried, refrigerated gas pipelines in which the natural gas is transported in a gaseous state at high pressures and at temperatures below 32° F. (0° C.). A discussion of refrigerated gas pipelines is given by G. King, "The How and Why of Cooling Arctic Gas Pipelines", Parts I and II, *Pipeline and Gas Journal* (September and October, 1977). Refrigerated gas pipelines will be required to traverse great distances and must be compatible with the various soil conditions which will be encountered.

Substantial portions of these pipelines will be located in regions of permafrost, which has been defined as a permanently frozen layer at variable depth below the earth's surface in frigid regions. Ice may constitute up to 90% of the total volume of permafrost. In general, permafrost, if it remains frozen, has very good structural strength. A. C. Matthews, "Natural Gas Pipeline Design and Construction in Permafrost and Discontinuous Permafrost", SPE 6873 (1977). One of the prime benefits of buried, refrigerated gas pipelines is their compatibility with permafrost. Operation of these pipelines at temperatures below 32° F. prevents degradation of the permafrost. Thus, the structural integrity of the pipeline system may be maintained without the use of pipe insulation or other protective measures.

Other sections of the pipeline must traverse thawed soils which often are frost-susceptible. A frost-susceptible soil is one which is subject to frost heaving when it freezes. Heaving generally occurs when the frost-susceptible soil contains an adequate supply of water and freezing temperatures are present. In that event, lenses of segregated ice tend to form within the soil. Typical frost-susceptible soils are silt, silty sand, and clay. With the exception of seasonal freezing of the upper layer, these frost-susceptible soils normally remain continuously thawed at a temperature above 32° F.

Between areas of continuous permafrost and areas of continuous thawed soils the pipeline will encounter areas of discontinuous permafrost. The pipeline system must also be compatible with this environment. Discontinuous permafrost comprises distinct patches of both marginal permafrost and thawed ground in a random array. By definition, the temperature of marginal permafrost is only slightly below 32° F.

When a refrigerated gas pipeline is incorporated into thawed soil, the cold pipeline becomes a heat sink which removes heat from the surrounding, warmer soil. This causes the formation of freeze bulbs around the pipeline and, potentially, heaving of the pipeline. This process is related to, but may be distinguished from, seasonal freezing of the soil due to seasonal changes in the ambient air temperature. The formation of freeze bulbs is a long term process, requiring perhaps several years to occur. However, frost heave can be a serious problem, because these pipelines may remain in service for decades. The degree of pipeline uplift due to frost heave is not uniform along the pipeline and the resulting differential movement can deform or even rupture the pipeline.

Reducing frost heave by freezing the thawed soil before the installation of the pipeline has been proposed. This may be done by using passive heat extraction devices to remove heat from the soil during the winter and to radiate the heat into the air. See, for example, those devices disclosed in U.S. Pat. No. 4,194,856 issued to Jahns (1980). Alternatively, the soil around the pipeline may be frozen by the use of passive heat extraction devices which are located below the refrigerated gas pipeline and operate continuously to remove heat from the surrounding soil. The pipeline itself is used as a continuously available heat sink. However, systems utilizing passive heat extraction devices may be quite costly. Hundreds of thousands of these units may be required to protect a long pipeline.

Several other methods have been proposed for dealing with the problem of frost heave of refrigerated gas pipelines. A discussion of the problems and current approaches for operating refrigerated gas pipelines in permafrost and thawed soil may be found in the article by A. C. Matthews, noted above. These methods include excavating a trench deeper than that required to accommodate the pipeline and replacing the frost-susceptible soil surrounding the pipeline with heave resistant material. Other proposed solutions include heavily insulating the pipeline, or heating the soil beneath the pipeline in order to prevent formation of the ice lenses, or taking both measures. Overexcavating and surrounding the pipeline with heave resistant material can delay and mitigate frost heave, but will not solve the problem. The same may be said for insulating the pipeline. Heating the soil generally will involve specialized construction techniques, as where individual electric heaters are installed. Careful surveillance and frequent adjustments of heating rates are also required. Further, adequate methods for monitoring pipeline heave are not yet available. These specialized techniques and devices inherently involve very high, possibly prohibitive costs when great lengths of a pipeline system require frost heave protection. Numerous transitions from frozen to thawed ground may be encountered with any major pipeline located in the cold regions of the world. For example, precautions will be taken to protect the Alaska Highway Gas Pipeline from frost heave over at least an 80 mile length. For details, see *Oilweek,* page 20 (Apr. 17, 1978).

SUMMARY OF THE INVENTION

Briefly, applicants deal with the problem of frost heave of pipelines transporting cold product through frost-susceptible soil by placing a blanket of heat absorbant material over the pipeline on the soil surface to increase the flow of heat into the region surrounding the pipeline. This technique may be used in combination with other frost heave mitigation techniques such as insulating the pipeline and supporting the pipeline with a heave resistant bedding material. Thus, the tendency of the pipeline to freeze the surrounding frost-susceptible soil is offset and the heave effects of any bulbs that do form around the pipeline are reduced.

In accordance with the present invention, a pipeline for transporting cold product having a temperature less than 32° F., such as refrigerated natural gas, is installed in a trench excavated in the earth. Pipe insulation is attached to the pipeline, thereby reducing heat flow from the surrounding frost-susceptible soil into the cold pipeline. The trench extends substantially below the bottom of the pipeline, and the space between the pipeline and the bottom and sides of the trench is filled with a granular, mineral bedding material which has a low frost heave potential and thus may be referred to as heave resistant bedding material. This heave resistant material serves two functions. First, it provides a uniform bed of a known consistency for supporting and protecting the pipeline in the trench. Second, the heaving effects due to any permanent freeze bulb which may occur and the heaving effects due to seasonal freezing will both be mitigated. The space in the trench above the pipeline may be filled with any fill material. Typically, this will be the material originally removed from the trench when it was excavated. However, this material may be the same as bedding material or may be another material.

Construction of a buried pipeline system necessarily results in a disturbance of the surface of the ground, both above the trench and for a substantial distance on either side thereof. This surface disturbance takes the form of damage to or destruction of the layer of organic material typically located immediately below the ground surface. Vegetation growing in this organic layer is also damaged or destroyed. In buried refrigerated gas pipeline systems of the prior art, the organic layer was either repaired following completion of the pipeline or simply allowed to regenerate itself over a period of time. The buried pipeline system of the present invention takes advantage of and perpetuates the surface disturbance. In a preferred embodiment of the invention, this enhancement of the surface disturbance is accomplished by stripping or totally removing the organic layer on both sides of the trench, and installing a blanket of granular, mineral material such as gravel in place of the organic material. This blanket of granular, mineral material serves two functions. First, the blanket has significantly higher thermal conductivity than the removed organic material. Thus, the heat input to the system from environmental sources during summer months is significantly increased over the prior art systems. During winter months, a natural covering of snow serves to mitigate loss of this added heat. Second, the blanket prevents or retards revegetation of the area which it covers, thereby preventing or retarding regeneration of the organic layer. The net effect of this system is to increase the temperature of the soil surrounding the pipeline by an amount sufficient to reduce or eliminate the long-term growth of freeze bulbs.

An added feature of the invention is that the work pad which is normally constructed along one side of the trench may be constructed so as to constitute a part of the blanket of granular, mineral material.

Finally, two additional elements may be added so as to enhance the overall thermal characteristics of the system. A coating or topping of a suitable material may be applied to the top surface of the blanket of granular, mineral material so as to increase the heat input to the soil during summer months. One or more snow fences may be erected substantially parallel to the trench so as to increase the depth of the winter snow cover, thereby reducing thermal losses during winter months.

DETAILED DESCRIPTION OF THE PREFERRED EMBODIMENT

Figure 1:
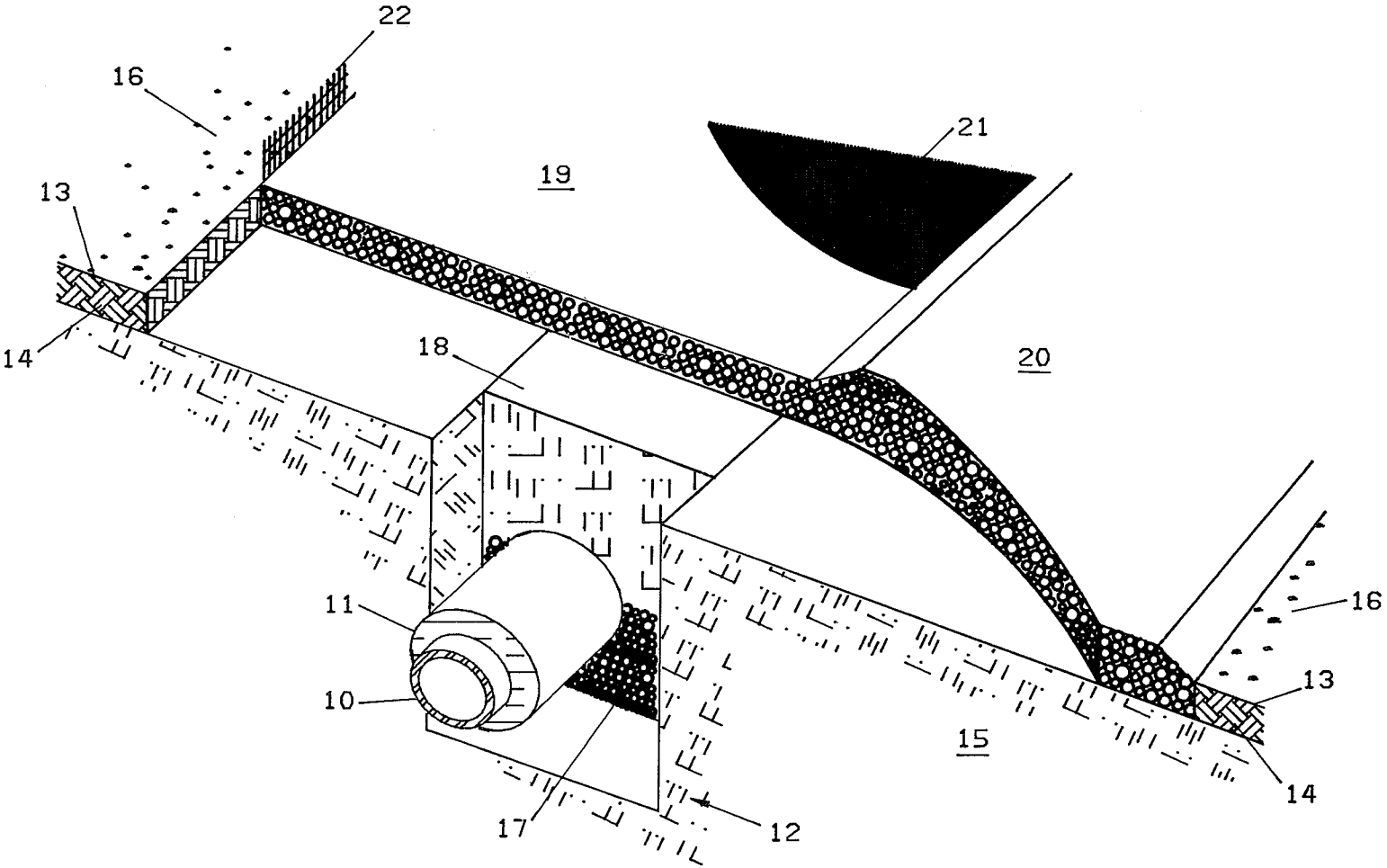
FIG. 1 is a perspective sectional view of a buried pipeline system embodying the present invention.

FIG. 1 shows a buried pipeline system embodying the present invention. A pipeline 10 for transporting refrigeraated natural gas is located in a trench 12 which has been excavated in the thawed, frost-susceptible soil through which the pipeline must pass. Preferably the trench extends at least to the maximum seasonal freeze depth of the soil. A coat of insulation 11 is attached to and circumscribes the pipeline. Its primary purpose is to retard the flow of heat from the frost-susceptible soil into the colder pipeline.

The soil consists of a surface 13, an upper layer of organic material 14, and a lower layer of mineral material 15. The lower layer 15 normally consists of gravel, sand, silt, clay or rock, or any combination of gravel, sand, silt, clay or rock. During summer months vegetation 16 grows freely on the top surface 13.

The trench 12 is deep enough so that the bottom of pipeline 10 is located substantially above the bottom of the trench 12 when the top of pipeline 10 is located at or below the bottom of the upper layer of organic material 14. In this sense, the trench may be said to be overexcavated. The purpose of this overexcavation is to create enough room for a heave resistant or non-frost-susceptible bedding material 17. This material 17 is placed in the trench 12 below and on both sides of pipeline 10 and insulation 11. Typically this bedding material would be material such as fine gravel or a relatively clean sand. If desired, it may have heat insulating characteristics and thus will supplement the effects of insulation 11. Further, an additional layer of special insullation (not shown) could be placed in the bottom of trench 12. The bedding material extends from the bottom of the trench 12 upwardly to a level substantially equal to or above the level of the transverse horizontal centerline of pipeline 10. The remainder of the trench is then backfilled with fill material 18. This material may be selected from a broad range of readily available materiala. Typically, it will be the soil which was excavated from the trench. Fill material 18 may also be the same material as bedding material 17.

The upper layer of organic material 14 has been removed on each side of trench 12 for a distance of about one to three times the depth of the trench 12. This removal creates space for a blanket 19 of granular, mineral material to be installed over the pipeline 10. The purpose of blanket 19 is to retard the growth of vegetation over the pipeline and to promote the flow of heat into the pipeline system and the surrounding region. The granular, mineral material of the blanket 19 may be the same as or different from the bedding material 17. Typically, the blanket 19 will be gravel. In any event, preferably blanket 19 will be erosion-resistant, water permeable, vegetation-resistant, and atmospheric thermal energy-absorbent. Blanket 19 may include work pad 20, which normally would be constructed prior to excavation of the trench 12. A suitable coating 21 may be applied to the top surface of the blanket 19 to enhance the heat input to the system. This coating 21 could be tar or a similar substance. The coating should increase absorption of thermal radiation, decrease convective cooling by decreasing surface roughness, and decrease evaporative cooling. One or more snow fences 22 may be installed to increase the depth of the winter snow covering in the vicinity of the pipeline, thereby reducing heat losses from the system during winter months.

Refrigerated gas pipeline 10 is a large diameter, high pressure, refrigerated gas transmission line. usually, the top of the pipeline will be at least thirty inches below the top surface of blanket 19. Typically the diameter of the pipeline would be from thirty-six inches to fifty-six inches. The diameter of the pipeline together with the operating pressures will govern the gas throughput and the required capacity of the associated compressing and cooling facilities. These large diameter pipelines are designed to operate at maximum pressures ranging from about one thousand to about two thousand one hundred pounds per square inch. Combination cooling/compressor stations are located at intervals along the pipeline, so that the gas can be maintained at a high pressure and at temperatures between about 0° and about 32° F., preferably from about 15° to about 30° F.

Thus, the present invention solves the problem of long-term freeze bulb growth and resulting frost heave by offsetting the disturbance of the soil thermal regime due to the presence of the refrigerated gas pipeline with a second disturbance of the soil thermal regime due to the enhanced surface disturbance. Again referring to FIG. 1, the blanket 19 of granular, mineral material is a better thermal conductor than the upper layer of organic material 14 which it replaced. Other beneficial aspects of the blanket 19 are lower latent heat, higher thermal radiation absorptivity, lower surface roughness, and lower water evaporation. Thus, the heat input to the system during summer months is increased over that which occurs in the undisturbed thermal regime. This increased heat input tends to balance the heat loss due to the presence of the refrigerated pipeline and the system is returned to or toward an equilibrium position at a temperature in excess of 32° F. Snow cover during winter months prevents excessive heat loss from the system.

Figure 2:
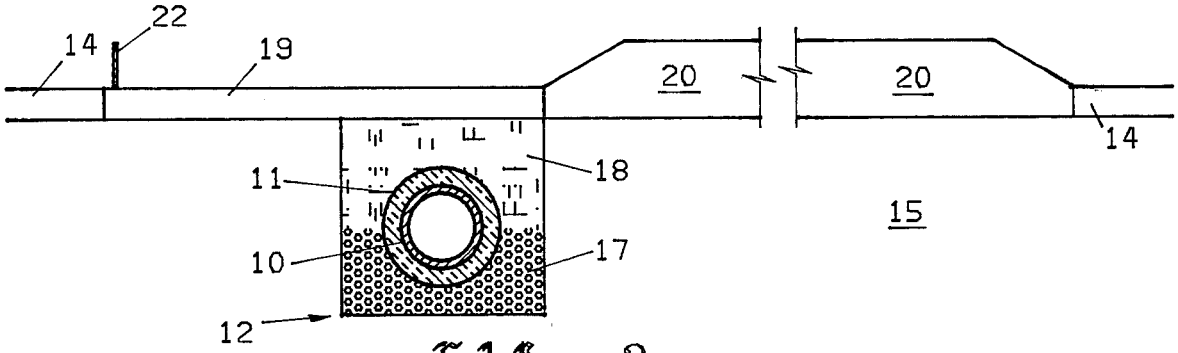
FIGS. 2 through 5 are schematic, cross-sectional end views of various embodiments of the present invention.
Figure 3:
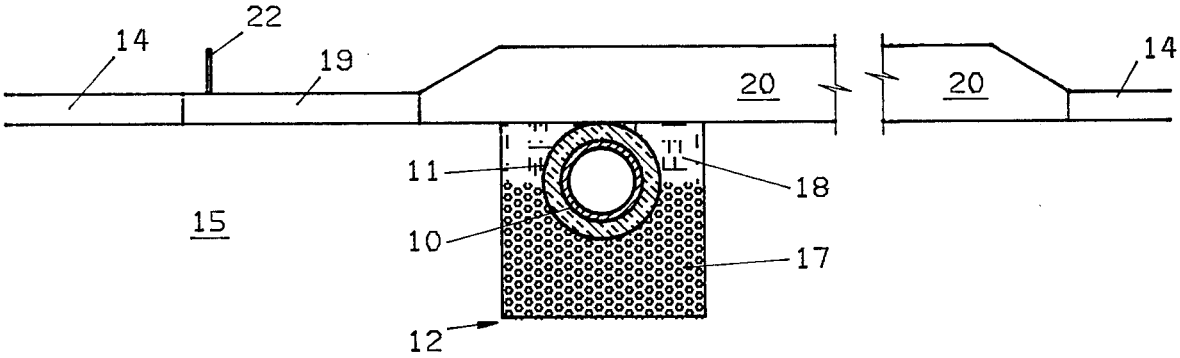
Figure 4:
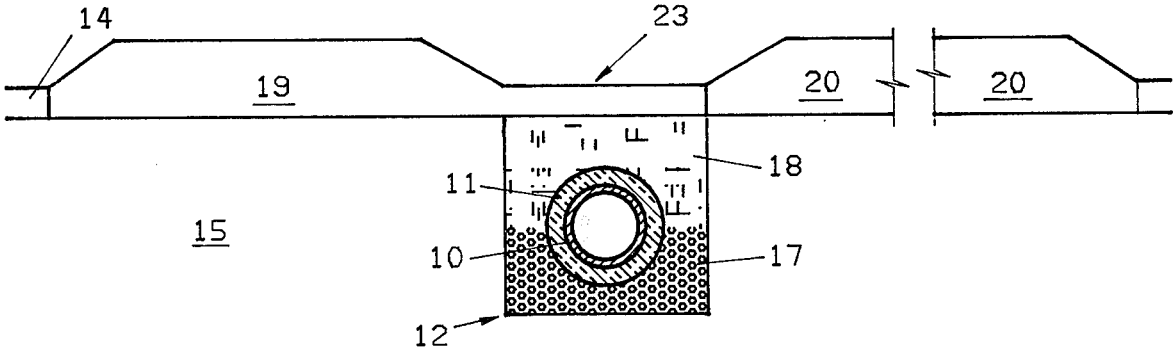
Figure 5:
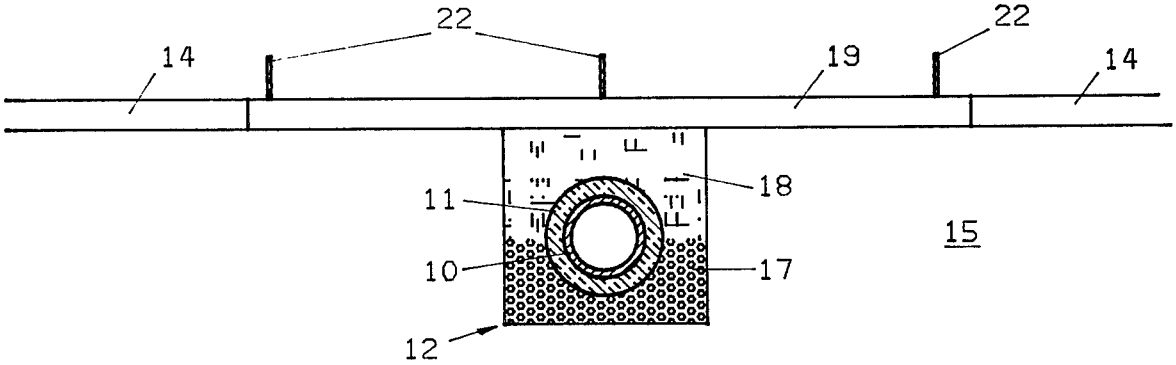

FIGS. 2 through 5 illustrate various embodiments of the present invention. FIG. 2 shows the system as described above. FIG. 3 shows the system with the work pad 20 extended so as to cover the trench 12. This increases the thickness of the blanket 19 of granular, mineral material above the pipeline, and, accordingly, the pipeline can be located closer to the surface of the ground. This will reduce the required depth of the trench resulting in cost savings. FIG. 4 shows the system with the thickness of the blanket 19 of granular, mineral material on the side of the trench 12 opposite the work pad 20 increased so as to be level with the top of work pad 20. This creates a hollow 23 above trench 12 where snow can accumulate during winter months. FIG. 5 shows an embodiment of the invention wherein the blanket 19 of granular, mineral material is substantially uniformly thick. FIG. 5 shows this uniform blanket replacing the upper layer of organic material 14. However, some of the beneficial effects of the present invention may be obtained by simply spreading a uniform blanket of granular, mineral material directly on the surface of the upper layer of organic material 14. This will compress the upper layer of organic material 14 thereby reducing its insulating capacity, retarding revegetation, and providing uniform, predictable heat transfer characteristics. In either of these last two situations, a single snow fence 22 located directly above the pipeline or two snow fences 22 located on opposite sides of the blanket or a combination of all three snow fences 22 may be used to increase the depth of snow cover during winter months.

In practicing the preferred embodiment as shown in FIGS. 1 and 2, a work pad 20 is constructed along one side of the proposed trench. The work pad 20 is constructed by stripping or removing the top layer of organic material 14 and replacing it with a granular, mineral material. The depth of the granular, mineral material is normally such that the top of the work pad 20 is located substantially above the top surface 13 of the surrounding ground. Trench 12 is then excavated along one side of the work pad 20. Bedding material 17 is then placed in the bottom of trench 12. A pipeline 10 with insulation layer 11 is then placed in the trench 12 on top of bedding material 17 and additional bedding material 17 is placed around the pipeline 10, preferably at least up to the transverse horizontal centerline of pipeline 10. The depth of the trench 12 is such that when the pipeline 10 is located therein, the bottom of the trench 12 is substantially below the bottom of the pipeline 10 when the top of the pipeline 10 is at or below the bottom of the top layer of organic material 14. Fill material 18 is then placed in the trench above bedding material 17. Fill material 18 extends from the top of bedding material 17 upwardly to a point substantially level with the bottom of the top layer of organic material 14. The top layer of organic material on the side of the trench opposite the work pad 20 is then stripped or removed and a blanket 19 of granular, mineral material is installed in place thereof. The blanket 19 extends from the work pad 20 across the trench 12 and outwardly and away from the trench 12. The work pad 20 then functions as a part of the blanket 19. Preferably the width of the blanket on each side of the trench is at least equal to the depth of trench 12. However, this width could be less than the depth of the trench and some beneficial effects would still occur. Ordinarily this width would not be greater than about three times the depth of the trench, but it could be. For example, a typical work pad might be fifty feet wide. In that case, the width of the blanket (including the work pad) on the side of the work pad likely would exceed three times the depth of the trench. Even in such case, the width of the blanket on the other side of the trench should be substantial. The heat input to the system may be further enhanced by applying a coating 21 to the top surface of the blanket 19 and the top surface of the work pad 20. Snow fences 22 may be used to increase the depth of the winter snow cover thereby preventing excessive heat losses from the system.

In operation, in the warmer months, the blanket 19 promotes the flow of heat from the environment into the region surrounding the pipeline. In the colder months, the retention of this heat around the pipeline is aided by snow which accumulates over the blanket 19. The accumulation of snow is encouraged by fences 22 or hollow 23. As will be discussed below in detail, it has been discovered that this technique substantially mitigates the formation of long term frost bulbs. Surrounding the pipeline with insullation 11 further aids in preventing the cold product in the pipeline from freezing the frost-susceptible soil. The provision of heave resistant bedding material 17 tends to prevent frost heave, should some freeze bulb formation take place. As the following examples illustrate, in many cases this invention can eliminate frost heave entirely.

EXAMPLES

Figure 6:
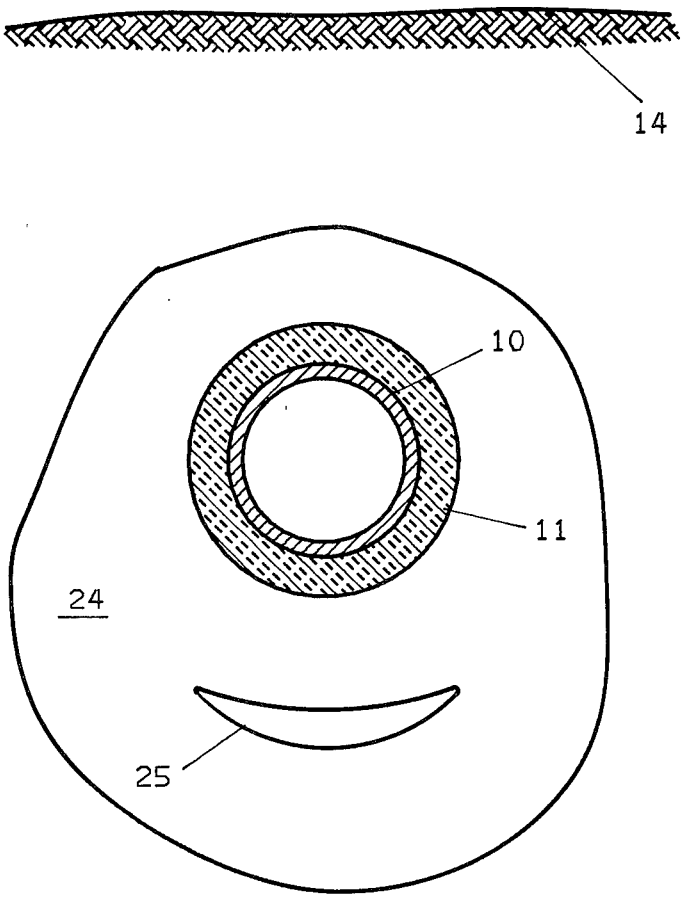
FIG. 6 PRIOR ART
FIG. 6 is a schematic, cross-sectional end view, showing the formation of a freeze bulb and an ice lens in a prior art buried pipeline system.
Figure 8:
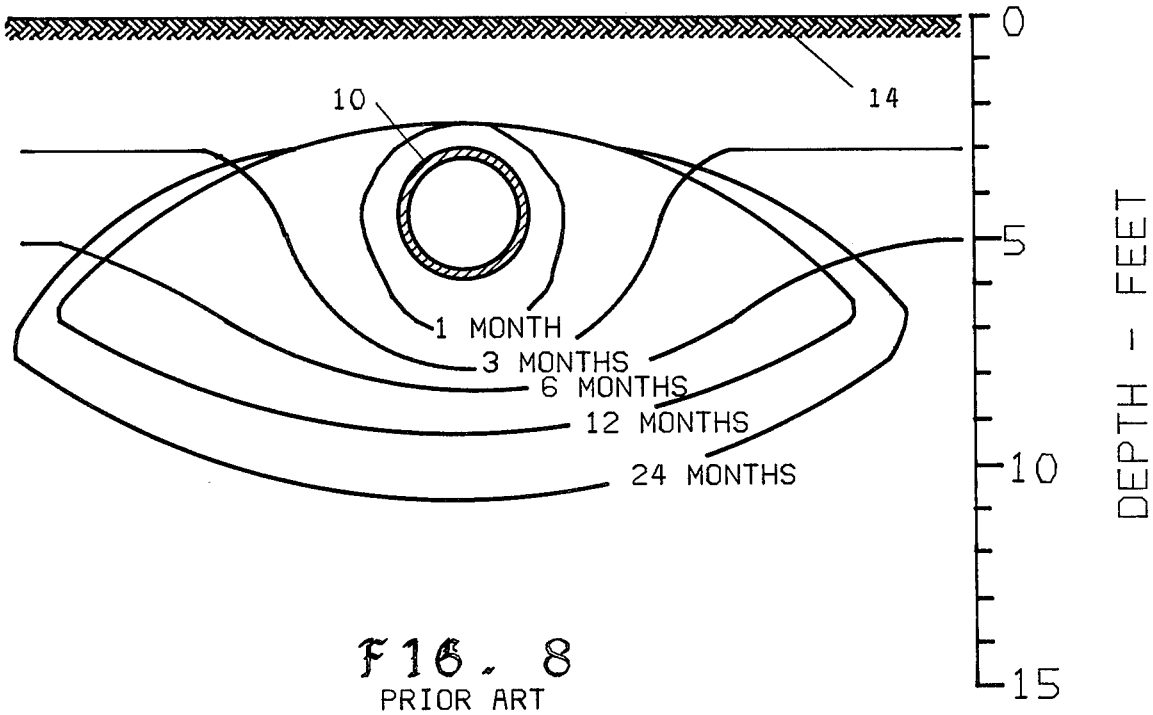
FIG. 8 PRIOR ART
FIG. 8 is a schematic, cross-sectional end view, showing the freeze bulb growth around a 25° F. prior art pipeline.
Figure 7:
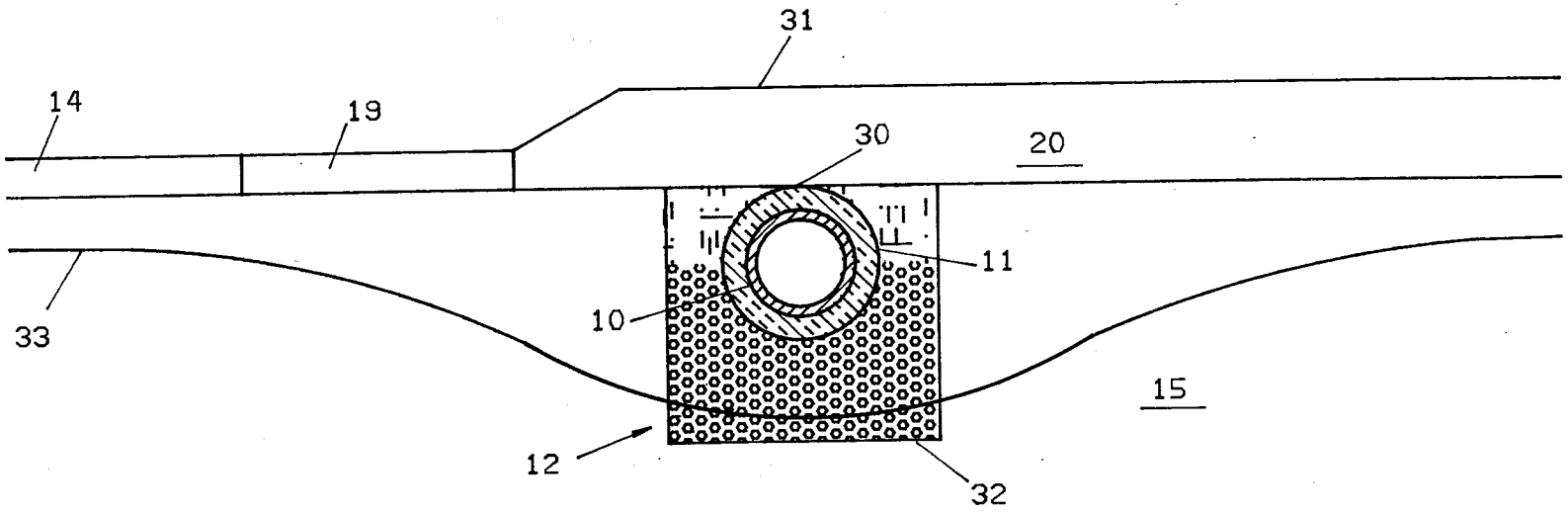
FIG. 7 is a schematic, cross-sectional end view, showing the seasonal freeze depth in the buried pipeline system embodying the present invention.

FIGS. 6, 7, and 8 illustrate in detail the mechanism of frost heaving and contrast the effects on the soil thermal regime of a pipeline installed with and without the techniques of the present invention. The specific parameters assumed for these examples are set forth below.

FIG. 6 shows the formation of a freeze bulb 24 around a prior art pipeline 10. Also shown is an ice lens 25 formed below the pipeline 10. Only one ice lens is shown to simplify the following discussion. Actually, the number, location, and shape of the lenses can vary greatly. During operation of the refrigerated gas pipeline 10, water tends to migrate through the soil and even into freeze bulb 24 to a point beneath the pipeline. As more water migrates to this region, and freezes and expands, the ice lens 25 thickens and exerts an upward pressure on pipeline 10. The location and rate of growth of the ice lens depend on many factors, including the temperature distribution in the soil, the type of soil, the upward force distribution due to the thickening ice lens, the availability of water, and the overburden pressure. The force exerted on pipeline 10 by the ice lens 25 may become sufficiently high to cause serious problems such as pipe deformation or even rupture. Insulation 11 is usually not sufficient by itself to prevent this long-term freezing due to the cooling effect of the refrigerated gas pipeline. At best, insulation 11 will act as a retarding factor, delaying the formation of freeze bulb 24 and ice lens 25 for a period of time.

Approximate two-dimensional thermal analysis of a buried pipeline system embodying this invention was performed in order to estimate the total system effect on the soil thermal regime. The configuration considered is shown in FIG. 7. The depth of the top 30 of pipeline 10 below the top surface 31 of the granular, mineral material was assumed to be a minimum of thirty inches. The depth from the top surface 31 of the granular, mineral material to the bottom 32 of trench 12 was assumed to be ten feet. The granular, mineral material was assumed to be gravel.

Analysis of the performance of the system was determined through the use of a computer program. The particulars of the computer program are not presented herein. Additional details on the programming approach are given in J. A. Wheeler, "Simulation of Heat Transfer from a Warm Pipeline Buried in Permafrost", presented at the Seventy-Fourth National Meeting of AIChE, New Orleans, Mar. 11–15, 1973; another example of the simulation techniques used is given by T. W. Miller, "The Surface Heat Balance in Simulations of Permafrost Behavior", presented at the Winter Annual Meeting of ASME, Houston, Nov. 30–Dec. 4, 1975. Writing programs based on the theory presented in these references and for duplicating the results presented herein is well known to those skilled in the art.

The parameters used in this two-dimensional thermal analysis of the system are as follows:

Soil Properties

Fine Silt (used to simulate the properties of lower layer of mineral soil 15)

Initial ambient temperature of 32.1° F.

Heat capacities of 36.2 BTU/ft$^3$/°F. (thawed) and 28.1 BTU/ft$^3$/°F. (frozen)

Thermal conductivities of 0.81 BTU/hrft°F. (thawed) and 1.26 BTU/hrft°F. (frozen)

Heat of fusion equal to 5370 BTU/ft$^3$

Gravel (used to simulate the properties of blanket 19 and work pad 20)

Initial ambient temperature of 32.1° F.

Heat capacities of 27.8 BTU/ft$^3$/°F. (thawed) and 24.0 BTU/ft$^3$/°F. (frozen)

Thermal conductivities of 1.52 BTU/hrft°F. (thawed) and 1.42 BTU/hrft°F. (frozen)

Heat of fusion equal to 900 BTU/ft$^3$

Fine Gravel (used to simulate the properties of bedding material 17 and fill material 18)

Initial ambient temperature of 32.1° F.

Heat capacities of 32.1 BTU/ft$^3$/°F. (thawed) and 26.0 BTU/ft$^3$/°F. (frozen)

Thermal conductivities of 1.76 BTU/hrft°F. (thawed) and 2.14 BTU/hrft°F. (frozen)

Heat of fusion equal to 1460 BTU/ft$^3$

Pipeline 48 inch outside diameter

Wall temperature of 15° F. when operating

Insulation thickness of 6 inches

Insulation conductivity of 0.02 BTU/hrft°F.

Trench Geometry

Blanket thickness of 30 inches

Trench depth from top of blanket of 10 feet

Trench width of 7 feet

Climatological Data

Based upon weather at Fairbanks, Alaska and a ground surface with no organic layer.

FIG. 7 shows the calculated seasonal freeze depth 33 that will be present in a buried pipeline system constructed according to the parameters of this example. Seasonal freezing is a cyclical effect, being present in winter months and disappearing in summer months. As shown in FIG. 7, the seasonal freeze depth below the pipeline 10 does not exceed the depth of the bottom 32 of the trench 12. Thus, heaving due to seasonal factors, if any, will be negligible and will be confined to the bedding material 17.

FIG. 8 illustrates the growth of a freeze bulb around an uninsulated prior art pipeline. The calculated freeze penetrations of five feet below the pipeline in the first year and an additional two feet in the second year are in good agreement with data obtained by Northern Engineering Services Limited at their Calgary (Canada) test site. For this experimental data see W. A. Slusarchuk, et al, "Field Test Results of a Chilled Pipeline Buried in Unfrozen Ground", *Proceedings of the Third Internationl*

*Conference on Permafrost*, sponsored by the National Research Council of Canada, Vol. 1, pp 877–883 (July 10–12, 1978).

FIG. 8 assumes that the pipeline becomes operational near the end of summer. The freezing front indicated by "1 month" indicates the position of the freeze bulb after one month of operation. The feezing fronts indicated by the labels "12 months" and "24 months" indicate the positions of the freeze bulb after operation for 12 months and 24 months respectively. This freeze bulb growth is distinguishable from seasonal freezing which is represented by the 3 month and the 6 month lines. The 6 month line shows the maximum position of seasonal freezing outside the permanent freeze bulb. This seasonal freezing will disappear during summer and reappear the following winter and normally is substantially shallower than long-term freezing.

Figure 9:
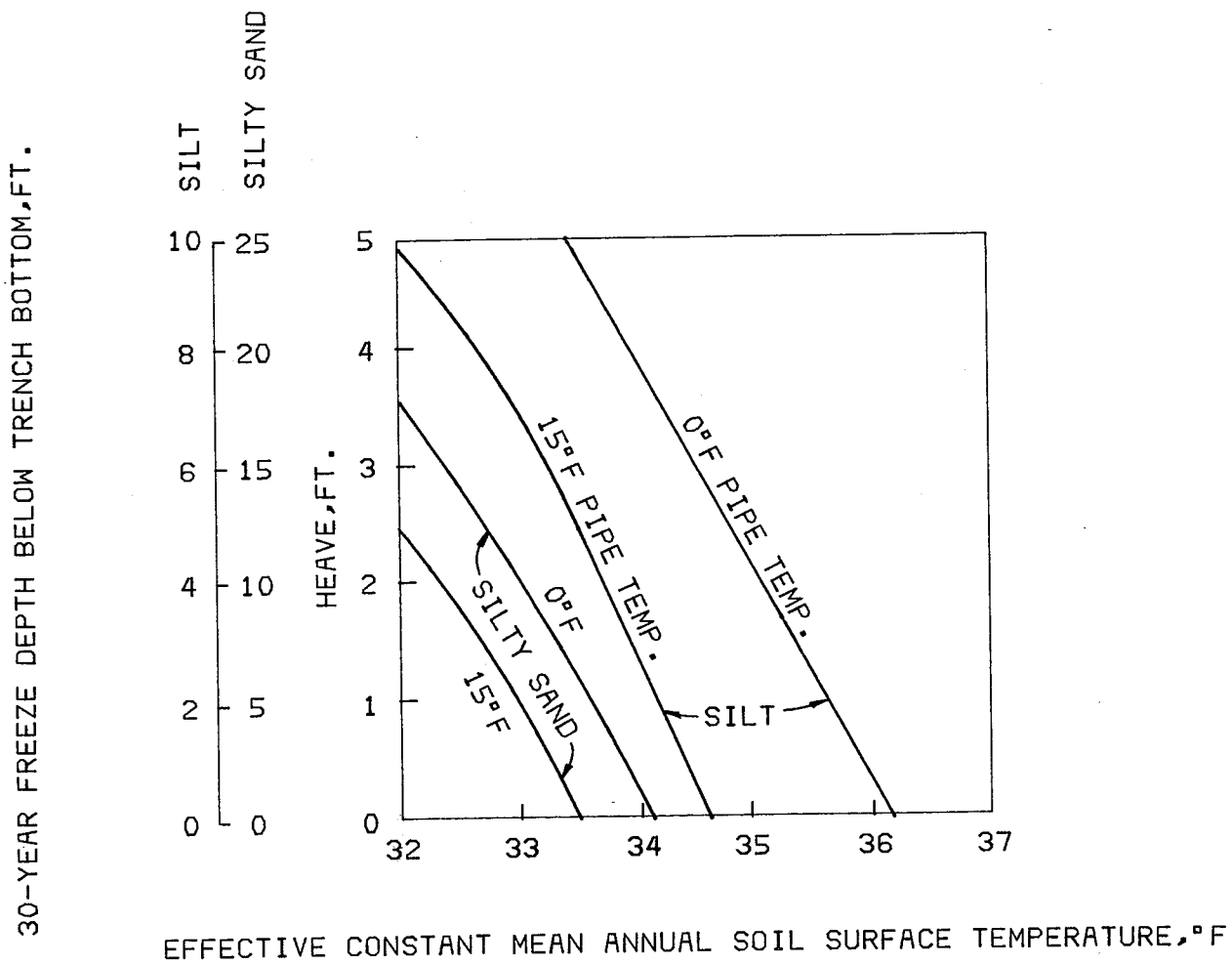
FIG. 9 is a graph which illustrates the sensitivity of frost heave in a buried, refrigerated, insulated gas pipeline system to small changes in surface temperature.

FIG. 9 is a plot of predicted freeze depth and heave versus soil surface temperature for the embodiment of the invention shown in FIG. 7. The pipe diameter was assumed to be forty-eight inches and the insulation thickness was assumed to be six inches. Two soil types, silt and silty sand, were examined. An initial uniform soil temperature of 32.1° F. was assumed. The properties of silty sand used were as follows:

Silty Sand (used to simulate the properties of lower layer of mineral soil 15)

Initial ambient temperature of 32.1° F.

Heat capacities of 32.7 BTU/ft$^3$/°F. (thawed) and 27.6 BTU/ft$^3$/°F. (frozen)

Thermal conductivities of 1.52 BTU/hrft°F. (thawed) and 1.75 BTU/hrft°F. (frozen)

Heat of fusion equal to 3,230 BTU/ft$^3$.

Other properties were the same as previously listed. The model further assumed a segregated ice content of 50% for silt. In other words, the silt heave strain was assumed to be 100%. Thus, the height of thawed silt doubled upon freezing. The segregated ice content for silty sand was assumed to be 20%. This concept is further illustrated by the dual ordinates on FIG. 9. One ordinate is labeled "30-Year Freeze Depth Below Trench Bottom, Ft." This ordinate has two sets of numbers, the outer set being for silt and the inner set for silty sand. The second ordinate is labeled "Heave, Ft." By way of example, a six foot freeze depth in silt will result in three feet of heave. In other words, the 50% segregated ice content has doubled the height of the silt. The abscissa is labaled "Effective Constant Mean Annual Soil Surface Temperature, °F.". This term is representative of the average soil temperature below the seasonally frozen layer in a pipeline system constructed according to the present invention. In the calculations leading to FIG. 9, values of this parameter were applied at the soil surface at the beginning of the calculation and kept constant throughout the simulated thirty year length of the calculation. Two different pipe temperatures, 0° F. and 15° F., are plotted for each soil type. As may be seen from the graph, the frost heave potential is highly sensitive to small variations in soil surface temperature. For example, a 0° F. pipeline in silt will have little or no heave for an effective mean annular soil surface temperature of 36° F. or higher, while the same pipeline will have five feet or more heave for effective mean annual soil surface temperatures of less than 34° F. Thus, an increase of approximately 4° above the initial temperature of 32.1° F. will eliminate frost heave. The corresponding increase for a 15° F. pipeline is only about 2½° F.

The method and apparatus of the invention and the best mode contemplated for applying that method have been described. It should be understood that the foregoing is illustrative only and that other means and obvious modifications can be employed without departing from the true scope of the invention defined in the following claims. For example, while this invention has been discussed in terms of a pipeline for carrying refrigerated natural gas, it is readily apparent that it applies equally to other cold products, including other gases, liquids, and slurries. Further, it should be apparent that the invention may be practiced with many other materials than those specifically mentioned. Additionally, the invention would apply to semi-buried or bermed pipeline systems which allow raising the pipeline relative to the ground surface for the primary purpose of reducing trench depth.

We claim:

1. A method for reducing frost heave in a buried pipeline system used for transporting product having a temperature less than 32° F. through frost-susceptible soil having a surface, an upper organic layer, and a lower mineral layer, said method comprising the following steps:

burying the pipeline substantially entirely in the lower mineral layer; and covering the pipeline and the region surrounding it with a blanket of heat absorbent, mineral material placed on the surface of the soil, said blanket of heat absorbent, mineral material extending on both sides of the pipeline for a distance at least equal to the distance from the surface of the soil to the bottom of the pipeline.

2. The method of claim 1, including the additional step of supporting the pipeline with a heave resistant bedding material.

3. The method of claim 1, including the additional step of surrounding the pipeline with a coat of thermal insulation.

4. The method of claim 1, including the additional step of erecting at least one snow fence at the surface over the pipeline.

5. A method for reducing or eliminating frost heave in a buried pipeline system used for transporting product having a temperature less than 32° F. through frost-susceptible soil having a surface, an upper layer of organic material, and a lower layer of non-organic material, said method comprising the following steps:

excavating a trench through the surface and the upper layer and into the lower layer to a preselected depth;

installing a pipeline in the trench so that the top of the pipeline is located essentially below the upper layer;

filling the trench with heave resistant bedding material at least to a level substantially equal to that of the transverse horizontal centerline of the pipeline;

installing fill material above the bedding material to a level substantially equal to that of the bottom of the upper layer;

removing the upper layer of organic material over the pipeline and on both sides of the trench for a distance at least equal to the depth of the trench; and installing a blanket of granular, mineral material in place of the organic material which was removed.

6. The method of claim 5, including the additional step of surrounding the pipeline with insulating material.

7. The method of claim 5, including the additional step of excavating the trench at least to the maximum seasonal freeze depth of the soil.

8. The method of claim 5, including the additional step of applying a heat absorbant coating to the top surface of the blanket of granular, mineral material.

9. The method of claim 5, including the additional step of erecting at least one snow fence on the blanket of granular, mineral material, the snow fence being substantially parallel to the trench.

10. A method for reducing or eliminating frost heave in a buried pipeline system used for transporting product having a temperature less than 32° F. through frost-susceptible soil having a surface, an upper organic layer, and a lower non-organic layer, said method comprising the following steps:

excavating a trench of a preselected width and having two sides and a bottom through the surface and the upper organic layer and into the lower non-organic layer to a preselected depth at least equal to the maximum seasonal freeze depth of the soil;

removing the upper organic layer on one side of the trench for a preselected distance;

constructing a work pad on the same side of the trench by installing a granular, mineral material in place of the organic layer which was removed;

installing a pipeline in the trench so that the top of the pipeline is located below the adjacent upper organic layer and the bottom of the pipeline is located substantially above the bottom of the trench;

filling the spaces between the pipeline and the sides and bottom of the trench with heave resistant bedding material, said bedding material extending upwardly from the bottom of the trench at least to a level substantially equal to that of the transverse horizontal centerline of the pipeline;

installing a fill material above the bedding material, said fill material extending from the top of the bedding material upwardly to a level substantially equal to that of the bottom of the upper organic layer;

removing the upper organic material on the side of the trench opposite the work pad for a distance at least equal to the depth of the trench;

installing a blanket of granular, mineral material in place of the organic material which was removed, said blanket extending from the work pad, across the trench and outwardly and away from the trench;

applying a heat absorbant coating to the top surface of the work pad and the top surface of the granular, mineral material; and erecting at least one snow fence on the blanket of granular, mineral material.

11. A buried pipeline system for transporting product having a temperature less than 32° F. through frost-susceptible soil having a surface and a lower soil layer, said system comprising:

a pipeline buried substantially entirely in the lower soil layer; and a blanket of graular, mineral material at the surface of the soil, said blanket covering the pipeline and extending laterally away from the pipeline on both sides of the pipeline for a distance at least equal to the distance from the surface of the soil to the bottom of the pipeline, said blanket of granular mineral material capable of increasing the heat input to the pipeline system during summer months from environmental sources enough to reduce frost heave of the pipeline.

12. The buried pipeline system of claim 11, wherein said blanket of granular, mineral material includes a portion adapted to serve as a work pad.

13. The buried pipeline system of claim 11, wherein said system further comprises a coat of thermal insulation surrounding the pipeline.

14. The buried pipeline system of claim 11, wherein the pipeline is substantially surrounded by a zone of heave resistant bedding material.

15. The buried pipeline system of claim 14, wherein said zone of bedding material extends substantially below the pipeline and said bedding material supports the pipeline.

16. The buried pipeline system of claim 11, wherein said blanket of granular, mineral material is covered with a heat absorbant coating to increase the flow of heat into the system.

17. The buried pipeline system of claim 11, wherein said blanket of granular, mineral material includes a central portion which is thinner than its other portions, so that said blanket gathers snow falling or blowing onto the blanket.

18. The buried pipeline system of claim 11, wherein said system further comprises at least one snow fence erected on the blanket of granular, mineral material to promote the accumulation of snow on top of the blanket.

19. The buried pipeline system of claim 11, wherein said system further comprises at least one snow fence erected adjacent to the blanket of granular, mineral material to promote the accumulation of snow.

20. The buried pipeline system of claim 11, wherein said blanket of granular, mineral material is at least four times as wide as the depth of the bottom of the pipeline below the soil surface.

21. The buried pipeline system of claim 11, wherein said blanket of granular, mineral material is at least six times as wide as the depth of the bottom of the pipeline below the soil surface.

22. The buried pipeline system of claim 11, wherein said blanket of graular, mineral material is thick enough to retard the growth of vegetation in the area covered by the blanket.

23. A buried pipeline system for transporting product having a temperature less than 32° F. through frost-susceptible soil having an upper organic layer and a lower mineral layer, said system comprising:

a trench of a preselected width excavated through the upper organic layer to a preselected depth;

a pipeline located in the trench and substantially beneath the upper organic layer;

heave resistant bedding material located in the trench and substantially surrounding the pipeline; and a blanket of granular, mineral material covering the trench and extending ouwardly and away from the trench on both sides thereof a distance at least equal to the depth of the trench, said blanket of granular, mineral material capable of increasing the heat input to the pipeline system from environmental sources over that which occurs naturally, thereby reducing frost heaving of the pipeline.

24. The buried pipeline system of claim 23, wherein said system further comprises a coat of thermal insulation attached to and circumscribing the pipeline.

25. The buried pipeline system of claim 23, wherein the trench is excavated to a point substantially below the pipeline, so that the bedding material extends below and supports the pipeline.

26. The buried pipeline system of claim 25, wherein the bedding material extends at least to the maximum seasonal freeze depth of the soil.

27. The buried pipeline system of claim 23, wherein said system further comprises a dark coating on the top surface of the blanket of graular, mineral material, whereby the thermal absorption of said pipeline system is increased.

28. The buried pipeline system of claim 23, wherein said blanket of granular, mineral material includes a portion adapted to serve as a work pad.

29. The bured pipeline system of claim 23, wherein said blanket of granular, mineral material includes a central portion which is thinner than the other portions, said thinner portion forming a hollow in which snow can accummulate during winter months.

30. The buried pipeline system of claim 23, wherein said system further comprises at least one snow fence erected on the blanket of granular, mineral material and substantially parallel to the trench, whereby the depth of the winter snow cover above the trench is increased.

31. The buried pipeline system of claim 23, wherein said blanket of granular, mineral material covers the trench and extends outwardly and away from the trench on both sides thereof a distance at least equal to twice the depth of the trench.

32. The buried pipeline system of claim 23, wherein said blanket of granular, mineral material covers the trench and extends outwardly and away from the trench on both sides thereof a distance at least equal to three times the depth of the trench.

33. The buried pipeline system of claim 23, wherein said blanket of granular, mineral material is thick enough to retard substantially the growth of organic material in the area covered by the blanket.

34. A buried pipeline system for transporting product having a temperature less than 32° F. through frost-susceptible soil having a surface, an upper layer of organic material, and a lower layer of non-organic material, said system comprising:

a pipeline buried substantially entirely beneath said upper organic layer;

a zone of heave resistant bedding material extending below the pipeline at least to the maximum seasonal freeze depth of the soil and at least up to a level substantially at the transverse horizontal centerline of the pipeline, said bedding material supporting the pipeline and displacing the soil under the pipeline;

a zone of fill material in the trench and above the pipeline, said fill material extending from the heave resistant bedding material to the surface above the pipeline;

a blanket of granular, mineral material at the surface of the soil above the pipeline, said blanket being thick enough to retard the growth of vegetation in the area covered by the blanket; and a work pad on the surface of the soil, said work pad being parallel to and in contact with the blanket and being wide enough so that it and the blanket have a combined width at least equal to the depth of the bottom of the pipeline in the soil, said work pad also being thick enough to retard the growth of vegetation in the area covered by the work pad.

35. The buried pipeline system of claim 34, wherein the blanket and work pad are of substantially uniform, equal thickness.

36. The buried pipeline system of claim 34, wherein the work pad is thicker than the blanket.

37. The buried pipeline system of claim 34, wherein the system also comprises a snow fence erected on the blanket.

38. The buried pipeline system of claim 34, wherein the work pad is thicker than the portion of the blanket adjacent the work pad and wherein the portion of the blanket adjacent the work pad is thinner than the portion of the blanket remote from the work pad, so that the blanket and work pad together define a depression in which snow can gather.

* * * * *